US006457458B1

(12) United States Patent
Frank et al.

(10) Patent No.: US 6,457,458 B1
(45) **Date of Patent: *Oct. 1, 2002**

(54) FUEL-DELIVERY MODULE WITH AN INTEGRATED FUEL FILTER

(75) Inventors: Kurt Frank, Schorndorf; Steffen Mihatsch, Asperg; Dieter Schreckenberger, Marbach, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/590,424

(22) Filed: Jun. 8, 2000

(30) Foreign Application Priority Data

Jun. 11, 1999 (DE) ..... 199 26 687

(51) Int. Cl.[7] ..... F02M 37/04
(52) U.S. Cl. ..... 123/509
(58) Field of Search ..... 123/509, 510

(56) References Cited

U.S. PATENT DOCUMENTS 5,564,396 A 10/1996 Kleppner et al. ..... 123/509
5,642,718 A * 7/1997 Nakai et al. ..... 123/509
5,647,330 A * 7/1997 Sawert ..... 123/509
5,778,926 A * 7/1998 Tanaka et al. ..... 123/508
6,129,074 A * 10/2000 Frank ..... 123/509
6,142,126 A * 11/2000 Kanamaru ..... 123/509
6,156,201 A 12/2000 Ueda et al. ..... 220/416.4
6,216,671 B1 * 4/2001 Sawert ..... 123/509
6,220,227 B1 * 4/2001 Okada et al. ..... 123/509

FOREIGN PATENT DOCUMENTS

| | | |
|---|---|---|
| DE | 44 14 281 A1 | 10/1995 |
| FR | 2 783 569 | 3/2000 |
| JP | 9-32674 | 2/1997 |
| JP | 2000-87820 | 3/2000 |
| WO | 98/40620 | 9/1998 |

* cited by examiner

*Primary Examiner*—Thomas N. Moulis
(74) *Attorney, Agent, or Firm*—Michael J. Striker

(57) ABSTRACT

An arrangement for forwarding fuel from a fuel tank to an internal combustion engine includes a fuel-forwarding device having a suction side and an elevated pressure side. An inlet conduit connects the suction side with the fuel tank, while a fuel-forwarding conduit forwards the fuel from the elevated pressure side. A fuel filter housing for accommodating a fuel filter surrounds the fuel-forwarding device. The fuel filter housing is connected with the fuel-forwarding device in an electrically conductive manner. One of the fuel filter housing and the fuel-forwarding device is connected to a location that is at a predetermined electrical potential.

13 Claims, 1 Drawing Sheet

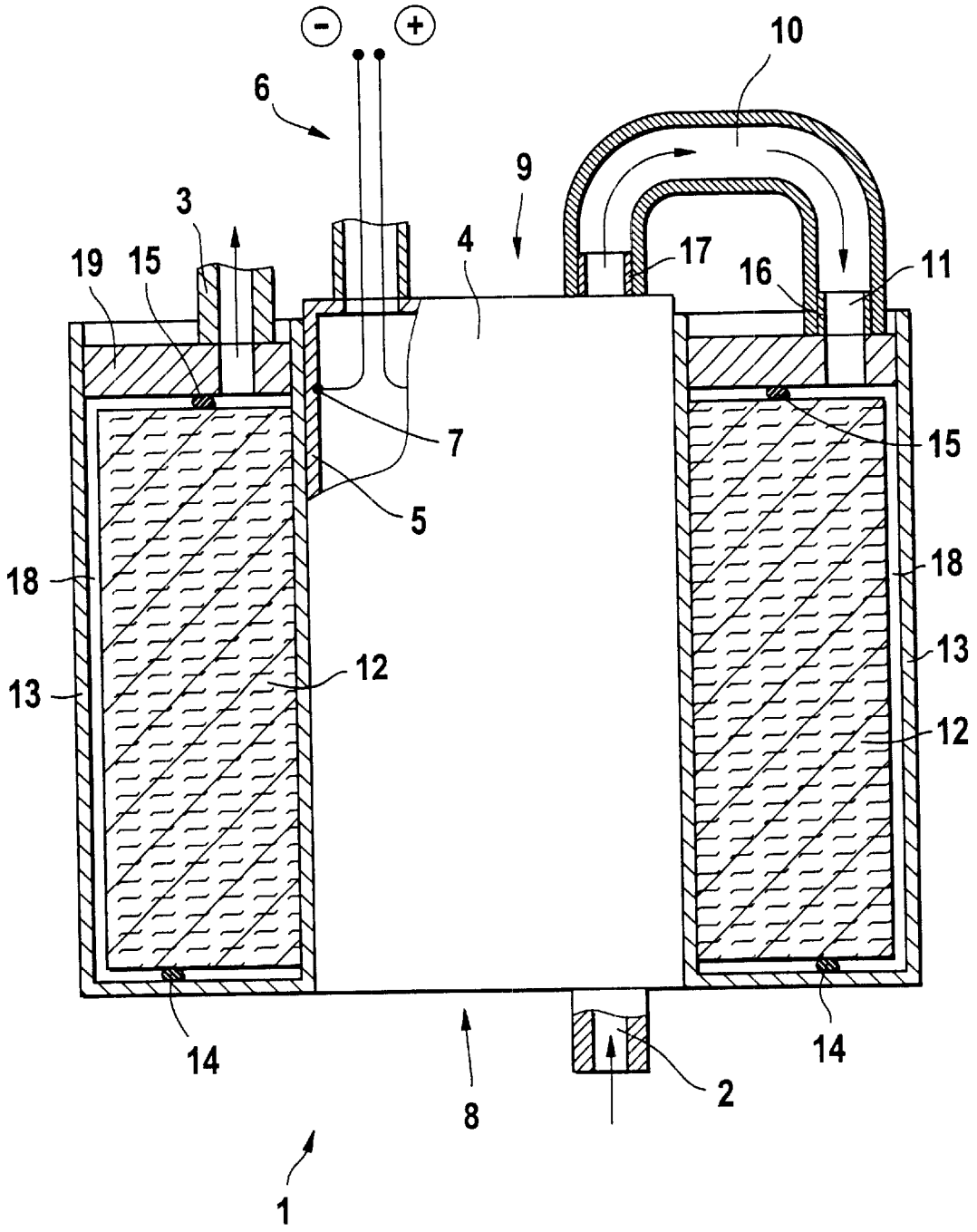
-
+
6
10
9
3
4
17
16
11
19
15
7
15
5
18
18
13
12
13
12
14
14
8
2
1

FUEL-DELIVERY MODULE WITH AN INTEGRATED FUEL FILTER

BACKGROUND OF THE INVENTION

1. Field of the Invention

The present invention relates to fuel delivery systems in general, and more particularly to internal combustion engine fuel pumps integrated with fuel filters.

2. Description of the Related Art

There are already known various constructions of fuel delivery systems for internal combustion engines, among them that revealed in the patent publication DE 44 14 281 A1. In this particular configuration, there is provided a fuel-forwarding device, and a disk-shaped filter and a ring-shaped filter are arranged downstream of this fuel-forwarding device. For facilitating the mounting of the fuel-delivery arrangement in the fuel tank, there is provided a common filter housing into which the fuel-forwarding device, the disk-shaped filter and the ring-shaped filter are integrated.

When the fuel-forwarding device and the fuel filter housing are, for instance, connected with one another directly in a synthetic plastic material housing or indirectly via decoupling elements, it can happen that, because synthetic plastic materials are, for the most part, electrically non-conductive, the fuel filter could become electrically charged owing to the fuel flow through the fuel filter housing. This is, of course, a highly undesirable situation to be encountered in fuel-delivery modules. A further disadvantage encountered in connection with housings of synthetic plastic materials is that they are, in most cases, relatively expensive in comparison with housings made of metal.

OBJECTS OF THE INVENTION

Accordingly, it is a general object of the present invention to avoid the disadvantages of the prior art.

More particularly, it is an object of the present invention to provide an internal combustion engine fuel-delivery module that does not possess the drawbacks of the known arrangements of this type.

Still another object of the present invention is to devise a fuel-delivery module of the type here under consideration in which the danger of electric charge accumulation is avoided.

It is yet another object of the present invention to design the above module in such a manner that the various components thereof are maintained at the same electric potential.

A concomitant object of the present invention is so to construct the module of the above type as to be relatively simple in construction, inexpensive to manufacture, easy to use, and yet reliable in operation.

SUMMARY OF THE INVENTION

In keeping with the above objects and others that will become apparent hereafter, one feature of the present invention resides in an arrangement for forwarding fuel from a fuel tank to an internal combustion engine. This arrangement includes a fuel-forwarding device having a suction side and an elevated pressure side; means including an inlet conduit for connecting the suction side with the fuel tank; means including a fuel-forwarding conduit for forwarding the fuel from the elevated pressure side; a fuel filter housing for accommodating a fuel filter surrounding the fuel-forwarding device; and electrically conductive means for connecting the fuel filter housing with the fuel-forwarding device.

A particular advantage of the arrangement as described so far is that the presence of the electrically conductive means assures that the fuel filter housing and the fuel forwarding device are always maintained at the same electrical potential, so that the possibility of electric discharge between them is eliminated.

Advantageously, the fuel-forwarding device includes a fuel-forwarding device housing; and the fuel filter housing is pressed onto the fuel-forwarding device housing. This feature brings about the advantages of, on the one hand, simple joining of the fuel filter housing and the fuel-forwarding device housing and, on the other hand, the existence of an extensive contact area between the fuel filter housing and the fuel-forwarding device. Other advantages of this approach is that it is not necessary to use any additional connecting elements, and that it is not necessary to manipulate such absent connecting elements.

Another advantageous feature of the present invention is to be found in the fact that the electrically conductive means includes an annular or a cylindrical electrically conductive contact region between the fuel-forwarding device housing and the fuel filter housing. The presence of such a region assures that the fuel-forwarding device housing and the fuel filter housing are always at the same electrical potential at all regions thereof.

This is especially advantageous when there is further provided means for connecting the fuel-forwarding device or the fuel filter housing with a location that is at a predetermined electric potential, especially that of the ground. This assures that, inasmuch as the fuel-forwarding device and the fuel filter housing are electrically connected with one another, they are both maintained at the predetermined electric potential.

According to an advantageous aspect of the present invention, each of the fuel-forwarding device housing and the fuel filter housing is of an electrically conductive material. This electrically conductive material is advantageously a metallic material. An important advantage of this is that such electrically conductive, especially metallic, housings have substantially uniform conductivity throughout, so that the possibility that a charge different from that of the remainders of the housings could accumulate at any region of either one of such housings is, for all intents and purposes, eliminated. In this context, it is especially advantageous when the fuel filter housing includes a lid element. This lid element, which allows easy access to the fuel filter accommodated in the interior of the fuel filter housing, may also be of a metallic material. However, in the alternative, it may even be of a synthetic plastic material.

The arrangement described above may constitute a part or all of a fuel-delivery module for forwarding fuel from a fuel tank to an internal combustion engine, and the latter is advantageously incorporated in a fuel-delivery system for an internal combustion engine.

The novel features that are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The sole FIGURE of the drawing is a partially sectioned side elevational view of an integrated device embodying the present invention and including an internal combustion engine fuel pump and a fuel filter.

DETAILED DESCRIPTION OF THE PREFERRED EMBODIMENT

Referring now to the drawing in detail, and first to FIG. 1 thereof, it may be seen that the reference numeral 1 has been used therein to identify an internal combustion engine fuel-delivery module in its entirety. The fuel-delivery module 1 includes, as one of its main components, a fuel-forwarding device 4, for instance a combination of a fuel pump with an electric motor powering the same. The fuel-forwarding device 4 is of a conventional construction, so that its constituent parts need not be described in detail or shown in the drawing; consequently, this device 4 has been only partially sectioned in the drawing to reveal some details of the present invention. The remainder of the fuel-delivery module 1 is shown in a somewhat simplified axial section, though.

An input conduit 2 connects the fuel-forwarding device 4 with a fuel tank, while an output port 9 serves to deliver fuel that the fuel-forwarding device 4 had brought to an elevated pressure to an overflow conduit 10. A pump housing 5 surrounds the fuel-forwarding device 4. In accordance with the invention, the pump housing 5 is electrically connected either with a source of a predetermined electrical potential different from ground potential, via an only diagrammatically indicated electric line 6, or, via an also merely diagrammatically indicated line 7, with a location that is at the ground potential. As a result of the provision of one or he other of such lines 6 and 7, the possibility that the housing 5 could become electrically charged is eliminated.

The fuel-forwarding device 4 draws the fuel in at its suction-side region 8 via the input conduit 2 and forwards the fuel at its pressure-side region 9 via a nipple 17 into the overflow conduit 10. One-way valves, which may be provided either at the suction-side region 8 or at the pressure-side region 9 of the fuel-forwarding device 4 in order to seal the fuel-delivery system against backflow, have not been shown in the drawing.

A filter housing 13 of an internal combustion engine fuel filter 12 extends around the fuel-forwarding device 4. A lid element 19 closes the filter housing 13 at one of its axial ends. The lid element 19 may be made of metal or of a synthetic plastic material, and it constitutes a portion of the filter housing 13 of the fuel filter 12. In order to be able to replace the annular fuel filter 12 that is then accommodated in the filter housing 13, it is possible to remove the lid element 19 from the remainder of the filter housing 13; such a removal gives access to the aforementioned annular fuel filter 12. The filter housing 13 of the fuel filter 12, which extends in an annular fashion around the housing 5 of the fuel-forwarding device 4, is in contact, at its inwardly situated surfaces, with the pump housing 5 and forms a conductive connection with the latter. In an advantageous implementation of the present invention, the filter housing 13 is pressed onto the pump housing 5 of the fuel-forwarding device 4; in this manner, an electrically conductive connection is formed between the housings 5 and 13 when each of the housings 5 and 13 is made of an electrically conductive material, preferably metal.

The annular fuel filter 12 is situated within the filter housing 13 for the fuel filter 12 which extends around the pump housing 5. The internal combustion engine fuel, which is supplied from the overflow conduit 10 through a nipple 16 into the interior of the filter housing 13, is pressed through the fuel filter 12 in order to remove from it by filtration even the finest-size contaminants. The fuel filter 12 is supported in the filter housing 13 by means of supporting and sealing elements 14 and 15. These supporting and sealing elements 14 and 15 center the fuel filter 12 in its desired position within the filter housing 13 and ensure the maintenance of uniform spacing 18 between the fuel filter 12 and the walls of the filter housing 13. On the other hand, however, the supporting and sealing elements 14 and 15 serve the purpose of preventing direct flow of unfiltered fuel past the fuel filter 12 into a fuel supply conduit. In this manner, a path through the filter 12 is imposed upon the fuel that enters the interior of the filter housing 13 through the nipple 16.

The filter housing 13 of the fuel filter 12 is preferably pressed onto the pump housing 5 of the fuel-forwarding device 4; in this manner, it is possible to avoid the otherwise existing need for using mechanical connecting elements or the like, and a simple joining is assured. The pressing of the filter housing 13 on the pump housing 5 forms an annular, or a cylindrically extending, coaxial contact region between the pump housing 5 and the inner surface of the filter housing 13. In the embodiment of the present invention that is depicted in the sole Figure of the drawing, the fuel-forwarding device 4 is connected, via the potential line 6, with a location that is at an electric potential different from the ground potential. There is also shown a grounding line 7 that establishes a grounding connection of the pump housing 5 with a location at the ground potential. As a result of the electrically conductive connection existing between the housings 5 and 13, the filter housing 13 is automatically grounded when the fuel-forwarding device 4 is grounded and hence is incapable of being electrically charged. In contradistinction to the above, the grounding of the fuel-delivery module 1 could also be accomplished in such a manner that the filter housing 13 would be grounded instead of the fuel-forwarding device 4. The electrically conductive connection between the filter housing 13 that would then be connected to a location of a predetermined electric potential and the pump housing 5 of the fuel-forwarding device 4 would then accomplish the grounding of the pump housing 5 or its connection to the location with the predetermined electric potential.

The fuel-delivery module 1, which basically consists of the fuel-forwarding device 4 and the fuel filter housing 13 pressed onto the latter, can then be advantageously secured, via the filter housing 13, on other structural parts; in this context, it would be merely necessary to assure the accessibility of the lid element 19 for the purpose of replacement of the ring-shaped fuel filter element 12.

As far as the electrically conductive materials for the housings 5 and 13 are concerned, they may be aluminum but also steel. Metal alloys could also be suitable for use as such materials, so long as they exhibit sufficient electrically conductive properties and prevent electric charging of the fuel-delivery module due to the fuel flow.

In the embodiment of the invention that is depicted in the drawing, the filter housing 13 has an annular configuration and surrounds the electric motor powered pump 4 that extends through it. However, the filter housing 13 could have another configuration just as well, so that a contact surface with a shape differing from the above-described annular or cylindrical contact surface configurations could result as the electrically conductive connection between the housings 5 and 13.

It will be understood that each of the elements described above, or two or more together, may also find a useful application in other types of constructions differing from the type described above.

While the present invention has been described and illustrated herein as embodied in a specific construction of a fuel-delivery device, it is not limited to the details of these particular constructions, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

What is claimed is:

1. An arrangement for forwarding fuel from a fuel tank to an internal combustion engine, comprising a fuel-forwarding device having a suction side and an elevated pressure side; means including an inlet conduit for connecting the suction side with the fuel tank; means including a fuel-forwarding conduit for forwarding the fuel from the elevated pressure side; a fuel filter housing for accommodating a fuel filter surrounding the fuel-forwarding device; and electrically conductive means for connecting the fuel filter housing with the fuel-forwarding device, wherein the fuel-forwarding device includes a fuel-forwarding device housing; and wherein the electrically conductive means includes an annular conductive contact region between the fuel-forwarding device housing and the fuel filter housing; and wherein the fuel filter housing is pressed onto the fuel-forwarding device housing.

2. The arrangement as defined in claim 1, wherein the fuel-forwarding device includes a fuel-forwarding device housing; and wherein the fuel filter housing is pressed onto the fuel-forwarding device housing.

3. The arrangement as defined in claim 1, wherein the fuel-forwarding device includes a fuel-forwarding device housing; and wherein the electrically conductive means includes a cylindrical conductive contact region between the fuel-forwarding device housing and the fuel filter housing.

4. The arrangement as defined in claim 1; and further comprising means for connecting the fuel-forwarding device with a location that is at a predetermined electric potential.

5. The arrangement as defined in claim 1, wherein the fuel-forwarding device includes a fuel-forwarding device housing; and further comprising means for connecting the fuel-forwarding device housing with a location that is at the ground electric potential.

6. The arrangement as defined in claim 1; and further comprising means for connecting the fuel filter housing device with a location that is at a predetermined electric potential.

7. The arrangement as defined in claim 1; and further comprising means for connecting the fuel filter housing device with a location that is at the ground electric potential.

8. The arrangement as defined in claim 1, wherein the fuel-forwarding device includes a fuel-forwarding device housing; and wherein each of the fuel-forwarding device housing and the fuel filter housing is of an electrically conductive material.

9. The arrangement as defined in claim 8, wherein the electrically conductive material is metal.

10. The arrangement as defined in claim 1, wherein the fuel filter housing includes a lid element; and wherein the lid element is of metal.

11. The arrangement as defined in claim 1, wherein the fuel filter housing includes a lid element; and wherein the lid element is of a synthetic plastic material.

12. A fuel-delivery module for forwarding fuel from a fuel tank to an internal combustion engine, comprising a fuel-forwarding device having a housing, a suction side and an elevated pressure side; means including an inlet conduit for connecting the suction side with the fuel tank; means including a fuel-forwarding conduit for forwarding the fuel from the elevated pressure side; a fuel filter housing for accommodating a fuel filter surrounding the fuel-forwarding device; and electrically conductive means for connecting the fuel filter housing with the fuel-forwarding device, and wherein the fuel filter housing is pressed onto the fuel-forwarding device housing.

13. A fuel-delivery system for an internal combustion engine, comprising a fuel-forwarding device having a housing a suction side and an elevated pressure side; means including an inlet conduit for connecting the suction side with a fuel tank; means including a fuel-forwarding conduit for forwarding the fuel from the elevated pressure side; a fuel filter housing for accommodating a fuel filter surrounding the fuel-forwarding device; and electrically conductive means for connecting the fuel filter housing with the fuel-forwarding device, and wherein the fuel filter housing is pressed onto the fuel-forwarding device housing.

* * * * *